US005579704A

United States Patent [19]

Mansur

[11] Patent Number: 5,579,704

[45] Date of Patent: Dec. 3, 1996

[54] APPARATUS FOR DISPOSING OF REFUSE BY THERMAL OXIDATION

[75] Inventor: Pierre G. Mansur, Miami, Fla.

[73] Assignee: Mansur Industries Inc., Miami, Fla.

[21] Appl. No.: 364,785

[22] Filed: Dec. 27, 1994

[51] Int. Cl.[6] ..... F23N 5/00; F23B 5/00; F23G 5/00

[52] U.S. Cl. ..... 110/185; 110/192; 110/193; 110/211; 110/242; 110/250

[58] Field of Search ..... 110/241, 242, 110/248, 250, 211, 216, 185, 192, 193, 229

[56] References Cited

U.S. PATENT DOCUMENTS

| | | | |
|---|---|---|---|
| 2,711,139 | 6/1955 | Martin | 110/211 |
| 2,905,115 | 9/1959 | Kendall | 110/211 |
| 5,363,777 | 11/1994 | Yoshimoto et al. | 110/241 X |

FOREIGN PATENT DOCUMENTS

| | | | |
|---|---|---|---|
| 3112976 | 1/1983 | Germany | 110/211 |

*Primary Examiner*—Henry A. Bennett
*Assistant Examiner*—Susanne C. Tinker
*Attorney, Agent, or Firm*—Robert M. Downey, P.A.

[57] ABSTRACT

A unit for disposing of refuse and contaminants by thermal oxidation includes a housing having a bottom, side walls and a top disposed in surrounding relation to an interior thereof. A partial wall structure divides the housing interior to define a first thermal oxidation chamber sized and configured to contain the refuse and contaminants and a second flue gas burning chamber disposed in air-flow communication with said first chamber. Heating elements are provided in the first and second chambers to raise the temperature to a predetermined level in order to induce thermal oxidation of refuse in the first chamber and the resultant flue gasses passing through the second chamber. An exhaust stack receives the flue gasses exiting from the second chamber and includes a filter therein for removing remaining contaminants from the flue gasses prior to entering the atmosphere.

12 Claims, 2 Drawing Sheets

FIG. 2
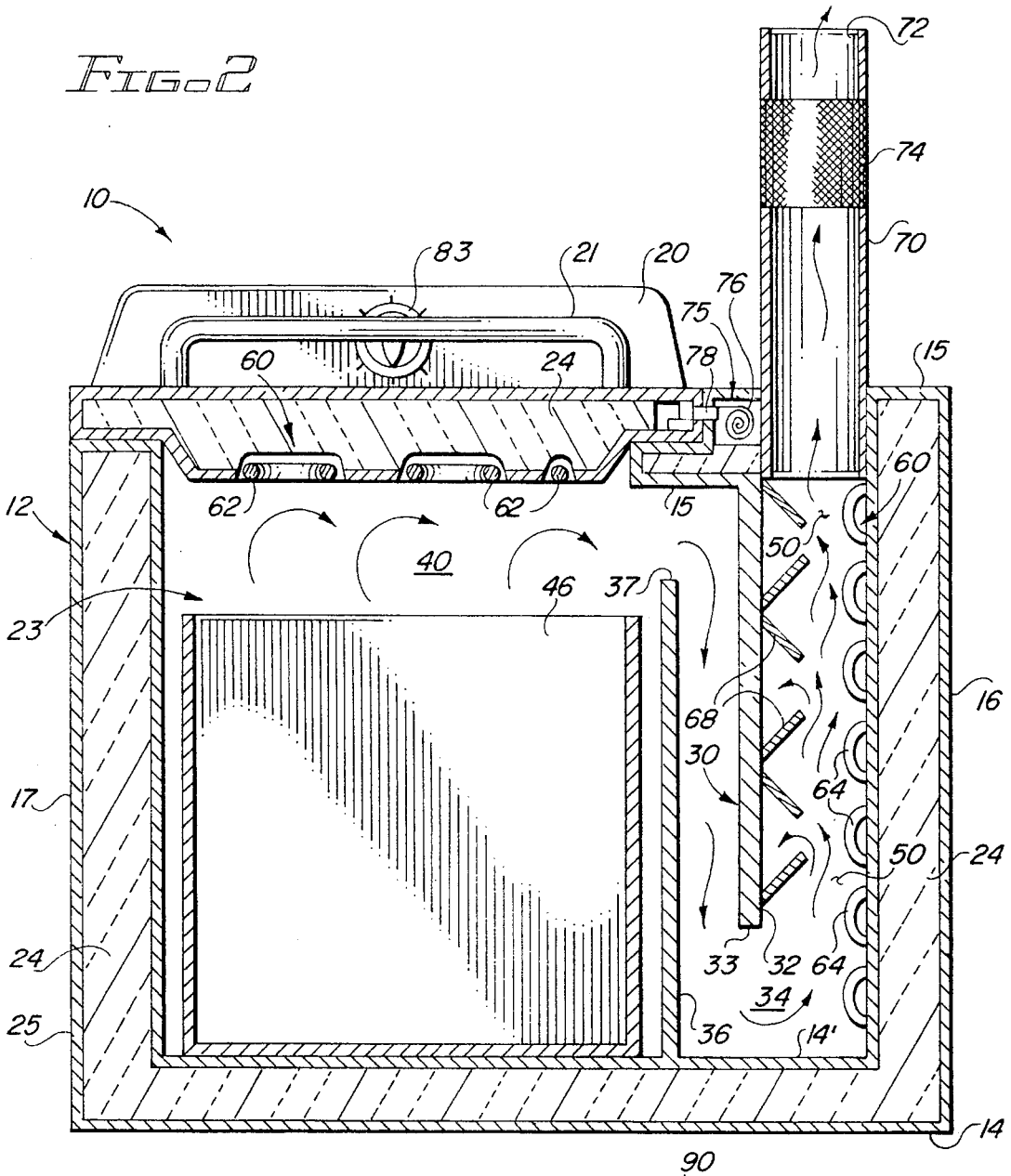
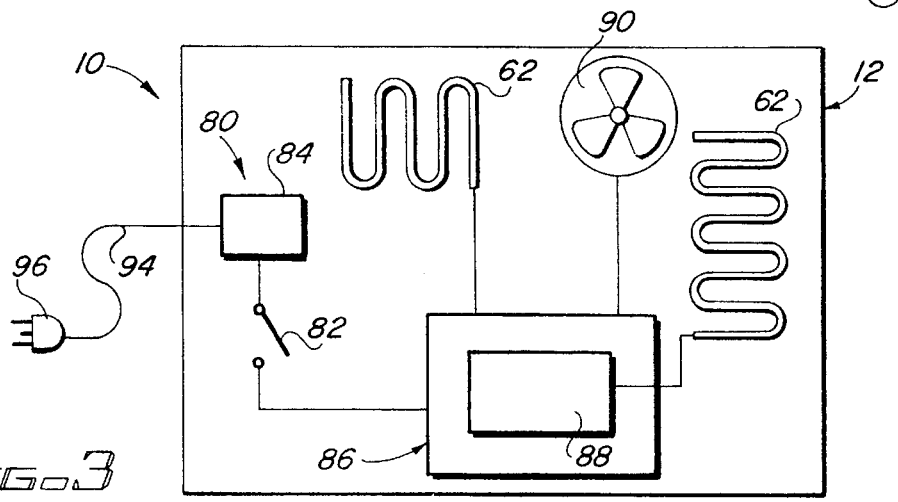
FIG. 3

APPARATUS FOR DISPOSING OF REFUSE BY THERMAL OXIDATION

BACKGROUND OF THE INVENTION

1. Field of the Invention

This invention relates to a unit for disposal of refuse and contaminants, and more particularly, to a portable unit for disposing of refuse and contaminants by thermal oxidation, producing close to zero emissions at elevated temperatures.

2. Description of the Related Art

The disposal of waste material presents numerous problems of environmental and economic concern. A common means of disposal of waste material, including contaminants, cardboard boxes, plastic, paper and other wastes products employs the use of incinerators to burn the waste material at high temperatures. While this method of disposal is effective to some degree, incinerators are generally large, cumbersome and costly to manufacture and operate. For this reason, most manufacturing facilities, medical facilities and other businesses need to transport waste material on a regular basis to a disposal facility having an incinerator.

Another problem associated with use of conventionally known incinerators is the difficulty in maintaining low emissions to minimize release of harmful pollutants to the atmosphere. The need to adapt to increasingly strict EPA disposal guidelines places an added burden on disposal facilities, and businesses, significantly increasing the cost of disposing of waste material.

In the related art, there have been various portable refuse treating apparatus developed which are suitable for use at a business facility having to dispose of waste material. In particular, the U.S. patent to Mogi, U.S. Pat. No. 5,170,724 discloses a burning apparatus having a burn-promoting plate which is specifically designed to burn fuel and refuse while giving rise to almost no smoke. The Mogi device employs the use of a burn-promoting plate which is designed to cause the refuse to be burned from top to bottom in a burning chamber. The refuse thrown in the burning chamber is ignited using fuel and a direct flame such as, for example, a match. Thus, the refuse is burned at relatively low temperatures. While this device is suitable for disposing of various waste material such as cardboard boxes, grass and bark, the burning method does not employ high enough temperatures for properly disposing of various contaminants, including sludge, grease and medical waste products.

The Dessi', U.S. Pat. No. 5,086,713, discloses a refuse-treating unit which is adapted to hold a predetermined amount of refuse in a chamber for sterilization by heat to convert the refuse into at least a partly converted sterilized mass. The sterilized mass is then compacted to convert the mass into a compact block. While the Dessi' treating unit is particularly suited for disposal of medical waste products, it is a significantly expensive apparatus to manufacture and, thus, is primarily limited to higher end users such as in the medical industry. Further, the Dessi' unit is not particularly suited for disposal of other contaminants and waste products such as those commonly found in maintenance and repair facilities, including grease, sludge, oily rags, contaminated absorbent materials and the like.

Accordingly, there is a definite need in all industries having to regularly dispose of refuse and contaminants for a portable, low cost device specifically structured to dispose of refuse and contaminants through thermal oxidation while producing close to zero emissions at elevated temperatures.

SUMMARY OF THE INVENTION

The present invention is directed to a device for disposing of refuse and contaminants by thermal oxidation.

More particularly, the present invention is directed to a portable, low cost device for disposing of refuse and contaminants such as, but not limited to, contaminated rags or wipes, oil and grease residue, contaminated absorbent materials and medical waste by thermal oxidation and including a housing having a bottom, side walls and a top disposed in surrounding relation to an interior thereof, At least one partial wall structure divides the housing interior to define a first thermal oxidation chamber sized and configured to contain the refuse and contaminants therein and a second flue gas burning chamber disposed in air-flow communication with the first chamber. The partial wall structure further defines a labyrinth to channel flow of flue gasses from the first thermal oxidation chamber to the second flue gas burning chamber.

Heating elements are provided in the first and second chambers to raise the temperature in order to induce thermal oxidation through convection. Baffle means in the second chamber serve to interrupt the flow of flue gasses therethrough, prolonging exposure of the flue gasses to the heating elements, and thus heating the flue gasses to a predetermined temperature to ensure more complete thermal oxidation and a maximum reduction of contaminant vapor discharge. The flue gasses continue from the second chamber to an exhaust stack having a filter therein for removing additional pollutants prior to the flue gasses entering the atmosphere.

A blower introduces air from atmosphere to the housing interior, thereby introducing sufficient oxygen to promote thermal oxidation.

Control means on the housing include a switch for actuating the blower and heating elements. The control means may further include timer means for cycling the heating elements between and on and off state in order to maintain a predetermined temperature in the housing interior, while further preventing damage to the heating elements. A portion of the top of the housing may be defined by a movable lid or door to facilitate access to the housing interior. A tank or tray, formed of a high temperature alloy material, may further be provided for containing the refuse and contaminants within the first chamber; the tray being removable from the housing interior through an access opening exposed when the door is removed therefrom.

Accordingly, with the foregoing in mind it is a primary object of the present invention to provide a portable, low cost device for disposing of refuse and contaminants by thermal oxidation.

It is another object of the present invention to provide a portable, compact device for disposing of refuse and contaminants by thermal oxidation, while producing close zero harmful emissions at elevated temperatures.

It is a further object of the present invention to provide a device or unit for disposing of refuse and contaminants by thermal oxidation and which employs the use of high temperature heating elements to generate temperatures in excess of 2,800 degrees fahrenheit within burning chambers of the unit, and including means for cycling the heating elements on and off to maintain a predetermined temperature and to prevent damage to the heating elements.

It is still a further object of the present invention to provide a unit for disposing of refuse and contaminants by thermal oxidation, and wherein the unit is portable and adapted to operate on common 110 volts.

It is still a further object of the present invention to provide a unit for disposing of refuse and contaminants and including high temperature heating elements to induce thermal oxidation through convection while producing close to zero emissions so as to provide a practical and economical means of complying with Environmental Protection Agency waste disposal guidelines.

It is yet another object of the present invention to provide a unit for disposing of refuse and contaminants, as described above, which complies with all government imposed safety requirements.

These and other objects and advantages of the present invention will be more readily apparent in the description which follows.

BRIEF DESCRIPTION OF THE DRAWINGS

For a fuller understanding of the nature of the present invention reference should be had to the following detailed description taken in connection with the accompanying drawings in which:

FIG. 2 is a front elevation, in partial section, of the refuse disposal unit; and FIG. 3 is a schematic diagram illustrating the various electrical components of the unit.

Like reference numerals refer to like parts throughout the several views of the drawings.

DETAILED DESCRIPTION OF THE PREFERRED EMBODIMENT

Figure 1:
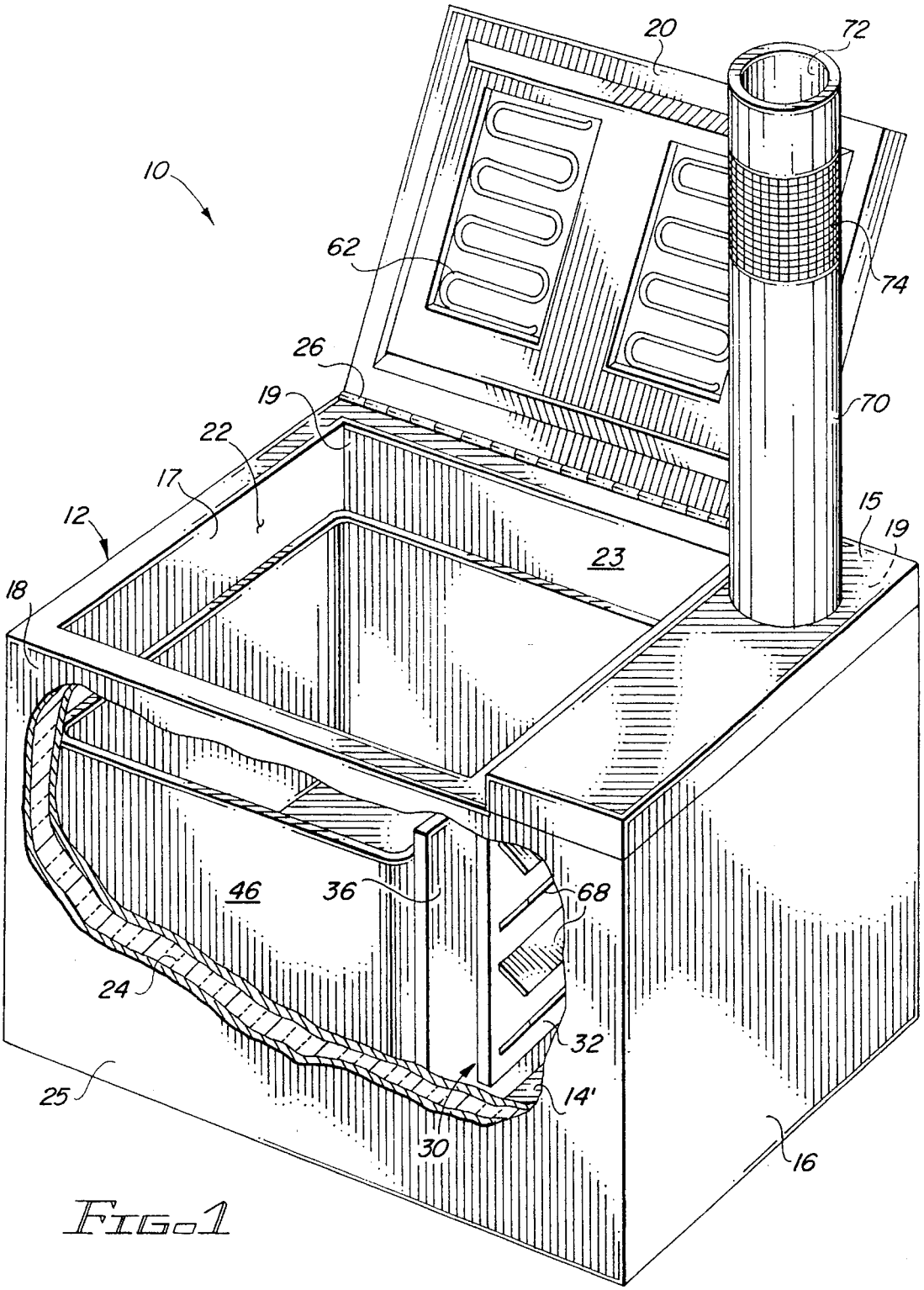
FIG. 1 is a front, top perspective view, in partial cut-away of the refuse disposal unit of the present invention.

Referring to the several views of the drawings, and initially FIGS. 1 an 2, there is generally illustrated the unit 10 of the present invention for disposing of refuse and contaminants. The unit 10 is comprised of a housing 12 including a bottom 14, side walls 16, 17, 18, 19 and a top 15 disposed in surrounding relation to an interior 23 of the housing 12. The housing further includes a movable door 20, defining at least a portion of the top 15 of the housing 12, the door 20 being hingedly attached to a remainder of the housing 12 by hinge means 26, whereupon movement of the door 20 to an open position, as seen in FIG. 1, exposes an access opening 22 through the top of the housing, thereby facilitating access to the interior 23. The exterior walls, including top 15, bottom 14 and side walls 16, 17, 18, and 19 are all provided with a ceramic insulation 24 to contain heat within the housing interior 23 and to prevent and outer skin 25 of the housing from becoming hot.

The interior of the housing includes a partial wall structure 30. In a preferred embodiment, the partial wall structure 30 includes a first partial wall 32 extending downwardly from the top 15 and terminating at a lower free distal edge 33 in spaced relation above an interior surface 14' of the bottom 14 so as to define a gap 34 therebetween. In a preferred embodiment, the partial wall structure 30 further includes a second partial wall 36 extending upwardly from the interior surface 14' of the bottom 14 and terminating at an upper free distal edge 37 in spaced relation below an interior surface 15' of the top 15 to define a gap 38 therebetween.

The partial wall structure 30, including first wall 32 and second wall 36 further serve to define a first thermal oxidation chamber 40 and a second flue gas burning chamber 50. The partial wall structure 30 forms a labyrinth to direct flue gasses (resulting from thermal oxidation of refuse in the first chamber 40) from the first chamber 40 to a lower portion of the second chamber 50. A tray 46 formed of a high temperature alloy material is provided for containing the refuse, contaminants and generally any waste material for thermal oxidation in the first chamber 40. The tray 46 is specifically sized and configured to be inserted and removed through the access opening 22, thereby facilitating placement and removal of the refuse from within the thermal oxidation chamber 40.

Heat generating means 60 are provided within the housing interior 23 including first heating elements 62 within the interior under-side of the door 20, as seen in FIGS. 1 and 2. Preferably the first heating elements 62 are at least partially embedded or recessed within the underside of the door 20 to prevent damage thereto when placing and removing the tray 46 from within the chamber 40.

A second set of heating elements 64 are provided within the second chamber 50, for burning flue gasses as they pass therethrough. Referring to FIG. 2 the flow of the flue gas is shown by the arrows, wherein the first heating elements 62 induce thermal oxidation of the contents within the tray 46, resulting in the flue gasses existing a top thereof. The flue gasses are thereafter directed through the labyrinth defined by the partial wall structure 30, and into a lower portion of the second chamber 50. Baffles 68 in the second chamber 50 serve to interrupt flow of the flue gasses through the second chamber 50, thereby prolonging exposure of the flue gasses to the heating elements 64. In a preferred embodiment, the heating elements 62, 64 are preferably high temperature super electronic heating elements capable of generating temperatures in excess of 2,800 degrees fahrenheit. Exposure of the flue gasses to the heating elements 64 in the second chamber 50 serves to ensure more complete thermal oxidation and a maximum reduction of contaminant vapor discharge into a flue stack 70. The flue stack 70 is further provided with a filter means 74, preferably a charcoal activated filter, which may be removable from the stack for cleaning and replacement. The filter means 74 removes remaining pollutants or contaminants in the flue gasses exiting the second chamber 50. Thereafter, gasses exiting to the atmosphere through the open top 72 of the flue stack 70 have close to zero harmful emissions.

To prevent accidental opening of the door 20 during thermal oxidation, and thus preventing injury, a lock means 75 is provided. Preferably, the lock means 75 is responsive to heat in the housing interior 23; locking the door 20 when temperatures are above a predetermined level in the housing interior 23. The lock means 75 may comprise a bi-metallic coil sensor 76 responsive to heat. A locking element 78 is movable into locked and unlocked engagement with the door 20 by the bi-metallic coil 76 in response to temperature changes within the housing interior 23.

Referring to FIG. 3, there is shown a schematic diagram of the various electrically operated components of the unit 10. In particular, there is a control means 80 including a switch 82 operable between an open and closed circuit position. The switch 82 may be of a dial timer device 83 (see FIG. 2.) in which a timer 84 is provided to maintain the switch 82 in a closed circuit position for a preset amount of time. Alternatively, the switch 82 may comprise simply a togel switch or other simple switch to open and close the circuit.

The control means 80 further includes a controller circuit board 86 having a switching mechanism 88 electrically connected with heating elements 62 and 64. The switching mechanism 88 is specifically structured to cycle current flow to the heating elements 62, 64 so that the heating elements 62, 64 are activated for a predetermined time period and then deactivated for a predetermined time period when the switch 82 is in the closed circuit position. In this manner, a predetermined temperature level can be maintained within the housing interior 23, while further preventing damage to the heating coils 62, 64 which may result from extended, uninterrupted operation.

A blower or fan 90 is further provided to supply air from atmosphere into the housing interior 23, thereby introducing sufficient oxygen to promote thermal oxidation of the refuse, contaminants or waste contents therein. The unit 10 is electrically powered by any conventional 110 volt power source, preferably using an electrical cord 94 having a plug 96 on a free end for plugging into a standard electrical socket. The cord 94 supplies electrical power to the switch 82 which, when closed, directs the electric power to the controller circuit board 86, heating elements 62, 64 and blower 90.

While the invention has been shown and described in what is considered to be a practical and preferred embodiment, it is recognized that departures may be made within the spirit and scope of the following claims which, therefore, should not be limited except within the Doctrine of Equivalents.

Now that the invention has been described.

What is claimed is:

1. A unit for disposing of refuse and contaminants comprising:

a housing including a bottom, side walls, and a top disposed in surrounding relation to an interior of said housing, and an access door movable between covering and uncovering relation to an access opening communicating with said housing interior, a first thermal oxidation chamber sized and configured to contain the refuse and contaminants for thermal oxidation therein, a second flue gas burning chamber disposed in air flow communication with said first chamber and structured for upward passage therethrough of flue gasses resulting from thermal oxidation of said refuse and contaminants, a labyrinth between said first chamber and said second chamber and structured for channeling the flue gasses from an upper portion of said first chamber to a lower portion of said second chamber, first heat generating means for increasing the temperature in said housing interior to a predetermined temperature in order to induce thermal oxidation of the refuse and contaminants contained therein, exhaust means communicating with said second chamber for exhausting the flue gasses to atmosphere and including a flue stack extending upwardly from a top of said second chamber in receiving relation to the upwardly rising flue gasses passing through said second chamber, second heat generating means in said second chamber for heating said flue gasses passing upwardly therethrough to promote upward rise of said flue gasses towards said exhaust means and to ensure more complete thermal oxidation and a reduction of contaminants in said flue gasses prior to entering said exhaust means, filter means contained in said flue stack for removing additional pollutants and contaminants from the flue gasses prior to entering the atmosphere, blower means for supplying air to the housing interior to provide oxygen at a sufficient rate and level in order to promote thermal oxidation of the refuse and contaminants therein, control means for actuating said first and second heat generating means and said blower means, and said control means including means for maintaining a predetermined temperature in said housing interior.

2. A unit as recited in claim 1 wherein said bottom, side walls and top of said housing include thermal insulation means therein to maintain heat within said housing interior and further to prevent an exterior of said housing from reaching harmful temperatures.

3. A unit as recited in claim 2 wherein said first and second heat generating means include high temperature electrical heating elements capable of generating temperatures in excess of 2,800 degrees fahrenheit.

4. A unit as recited in claim 3 wherein said second chamber includes baffle means therein for interrupting flow of the flue gasses therethrough and prolonging exposure of the flue gasses to said second heat generating means.

5. A unit as recited in claim 4 wherein said means for maintaining a predetermined temperature includes a switching mechanism for activating and deactivating said first and second heat generating means.

6. A unit as recited in claim 5 further including a tray formed of a high temperature resistant alloy material for containing the refuse and contaminants therein for thermal oxidation within said first chamber.

7. A unit for disposing of refuse and contaminants comprising:

a housing including a bottom, side walls, and a top disposed in surrounding relation to an interior of said housing, and an access door movable between covering and uncovering elation to an access opening communicating with said housing interior, a first thermal oxidation chamber sized and configured to contain the refuse and contaminants for thermal oxidation therein, a second flue gas burning chamber disposed in air flow communication with said first chamber and structured for upward passage therethrough of flue gasses resulting from thermal oxidation of said refuse and contaminants, a labyrinth between said first chamber and said second chamber and structured for channeling the flue gasses from an upper portion of said first chamber to a lower portion of said second chamber, first heat generating means for increasing the temperature in said housing interior to a predetermined temperature in order to induce thermal oxidation of the refuse and contaminants contained therein, exhaust means communicating with said second chamber for exhausting the flue gasses to atmosphere and including a flue stack extending upwardly from a top of said second chamber in receiving relation to the upwardly rising flue gasses passing through said second chamber, second heat generating means in said second chamber for heating said flue gasses passing upwardly therethrough to promote upward rise of said flue gasses towards said exhaust means and to ensure more complete thermal oxidation and a reduction of contaminants in said flue gasses prior to entering said exhaust means, filter means contained in said flue stack for removing additional pollutants and contaminants from the flue gasses prior to entering the atmosphere, blower means for supplying air to the housing interior to provide oxygen at a sufficient rate and level in order to promote thermal oxidation of the refuse and contaminants therein, lock means for locking said access door in covering relation to said access opening and preventing movement of said access door to an open position in uncovering relation to said access opening when temperatures within said housing interior are above a predetermined level, said lock means including a first element responsive to heat and a second locking element movable into locked and unlocked engagement with said access door by said first element in response to temperature changes within said housing interior, control means for actuating said first and second heat generating means and said blower means, and said control means including means for maintaining a predetermined temperature in said housing interior.

8. A unit as recited in claim 7 wherein said bottom, side walls and top of said housing include thermal insulation means therein to maintain heat within said housing interior and further to prevent an exterior of said housing from reaching harmful temperatures.

9. A unit as recited in claim 8 wherein said first and second heat generating means include high temperature electrical heating elements capable of generating temperatures in excess of 2,800 degrees Fahrenheit.

10. A claim as recited in claim 9 wherein said second chamber includes baffle means therein for interrupting flow of the flue gasses therethrough and prolonging exposure of the flue gasses to said second heat generating means.

11. A unit as recited in claim 10 wherein said means for maintaining a predetermined temperature includes a switching mechanism for activating and deactivating said first and second heat generating means.

12. A unit as recited in claim 1 further including a tray formed of a high temperature resistant alloy material for containing the refuse and contaminants therein for thermal oxidation within said first chamber.

* * * * *